US012492503B2

(12) United States Patent
Blatchley et al.

(10) Patent No.: US 12,492,503 B2
(45) Date of Patent: Dec. 9, 2025

(54) LAUNDRY APPLIANCE WITH ANTI-CLOSURE FEATURE

(71) Applicant: WHIRLPOOL CORPORATION, Benton Harbor, MI (US)

(72) Inventors: Timothy Blatchley, Stevensville, MI (US); Nolan Maryanski, Stevensville, MI (US); Bret J. Wamhoff, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 297 days.

(21) Appl. No.: 18/175,674

(22) Filed: Feb. 28, 2023

(65) Prior Publication Data

US 2024/0287729 A1 Aug. 29, 2024

(51) Int. Cl.

| | |
|---|---|
| ***D06F 39/14*** | (2006.01) |
| ***D06F 37/10*** | (2006.01) |
| ***D06F 37/28*** | (2006.01) |
| ***D06F 37/42*** | (2006.01) |

(52) U.S. Cl.

CPC ..... *D06F 39/14* (2013.01); *D06F 37/10* (2013.01); *D06F 37/28* (2013.01); *D06F 37/42* (2013.01)

(58) Field of Classification Search

CPC ..... D06F 37/10; D06F 37/28; D06F 37/42; D06F 39/14

See application file for complete search history.

(56) References Cited

U.S. PATENT DOCUMENTS

| | | | | |
|---|---|---|---|---|
| 4,257,173 | A | 3/1981 | Smith | |
| 6,685,241 | B2 | 2/2004 | Bollmann | |
| 9,181,647 | B2 | 11/2015 | Eglmeier et al. | |
| 10,066,334 | B2 | 9/2018 | Mora et al. | |
| 10,612,274 | B2 | 4/2020 | Kuehn et al. | |
| 10,815,609 | B2 | 10/2020 | Renz et al. | |
| 11,319,661 | B1 | 5/2022 | Maryanski et al. | |
| 2001/0024039 | A1* | 9/2001 | Lippoldt | B04B 7/06 292/201 |
| 2002/0073744 | A1* | 6/2002 | Bollmann | D06F 39/14 68/12.26 |
| 2004/0104580 | A1* | 6/2004 | Spiessl | F03G 7/0614 292/84 |

(Continued)

FOREIGN PATENT DOCUMENTS

| | | | |
|---|---|---|---|
| EP | 4424899 | A1 | 9/2024 |
| WO | 2008096222 | A2 | 8/2008 |
| WO | 2008096222 | A3 | 10/2008 |

*Primary Examiner* — Joseph L. Perrin

(74) *Attorney, Agent, or Firm* — Brooks Kushman P.C.

(57) ABSTRACT

A laundry appliance includes a drum and a cabinet configured to support the drum for rotation therein. The cabinet has a front face defining an opening that provides access into the drum. A door is pivotally attached to the cabinet and is movable between a closed position and an open position. A latch assembly secures the door in the closed position. The latch assembly includes a catch supported on one of the door and the front face and a striker supported on the other of the door and the front face. The striker is engageable with the catch to latch the latch assembly. One of the catch and striker is movable between a first position in which the catch and striker do not engage when the door is in the closed position and a second position in which the catch and striker can latch.

20 Claims, 4 Drawing Sheets

(56) References Cited

U.S. PATENT DOCUMENTS

| | | | | |
|---|---|---|---|---|
| 2010/0052338 | A1* | 3/2010 | Osvatic | E05B 17/0025 292/216 |
| 2011/0181053 | A1* | 7/2011 | Marschner | F16P 3/08 292/195 |
| 2012/0032569 | A1 | 2/2012 | Hill et al. | |
| 2016/0376742 | A1* | 12/2016 | Mcdonald | D06F 37/42 8/137 |
| 2023/0119079 | A1* | 4/2023 | Dirnberger | E05C 3/24 70/278.7 |
| 2023/0203741 | A1* | 6/2023 | Urbanski | D06F 37/22 68/20 |
| 2023/0203743 | A1* | 6/2023 | Scherr | D06F 58/02 34/108 |

* cited by examiner

LAUNDRY APPLIANCE WITH ANTI-CLOSURE FEATURE

TECHNICAL FIELD

This application relates to laundry appliances and more particularly to latches and associated components designed to inhibit inadvertent closure of a door.

BACKGROUND

Laundry appliances, including dryers, typically includes a rotating drum configured to holds clothes during a treating or drying cycle. During a drying cycle, hot air may be circulated through the drum to dry the clothes. A gas burner or an electric heating element may be used to heat the air while a motor may be configured to rotate the drum. The dryer may also include a fan and other components to facilitate drying. The drum may be accessed via a door that moves between open and closed positions to selectively offer access to the drum.

SUMMARY

According to one embodiment, a laundry appliance includes a drum, a cabinet configured to support the drum for rotation therein, the cabinet including a front face defining an opening that provides access into the drum, and a door pivotally attached to the cabinet and movable between a closed position and an open position. A latch assembly is configured to secure the door in the closed position. The latch assembly includes a catch supported on one of the door and the front face and a striker supported on the other of the door and the front face. The striker is engageable with the catch to latch the latch assembly, wherein one of the catch and striker is movable between a first position in which the catch and striker do not engage when the door is in the closed position and a second position in which the catch and striker are configured to engage when the door is in the closed position.

According to another embodiment, a laundry appliance includes a drum and a cabinet configured to support the drum for rotation therein. The cabinet including a front face defining an opening that provides access into the drum. A catch mounted on the front face, a door pivotally attached to the cabinet and movable between a closed position and an open position, and a striker configured to engage with the catch. The striker being movably mounted on the door such that the striker includes a first position in which the catch does not engage with the striker when the door is in the closed position and a second position in which the catch and striker engage when the door is in the closed position to latch the door to the cabinet.

According to yet another embodiment, a laundry appliance includes a drum and a cabinet configured to support the drum for rotation therein. The cabinet has a front face defining an opening that provides access into the drum. A door is pivotally attached to the cabinet and is movable between a closed position and an open position. A latch assembly has a catch and a striker engageable to secure the door in the closed position. A blocking member is movable between a blocking position that prevents the catch and striker from engaging when the door is in the closed position and a retracted position that allows the catch and the striker to engage when the door is in the closed position. The blocking member is biased towards the blocking position to inhibit inadvertent latching of the door. An actuator is configured to move the blocking member to the retracted position when actuated to allow latching of the door.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
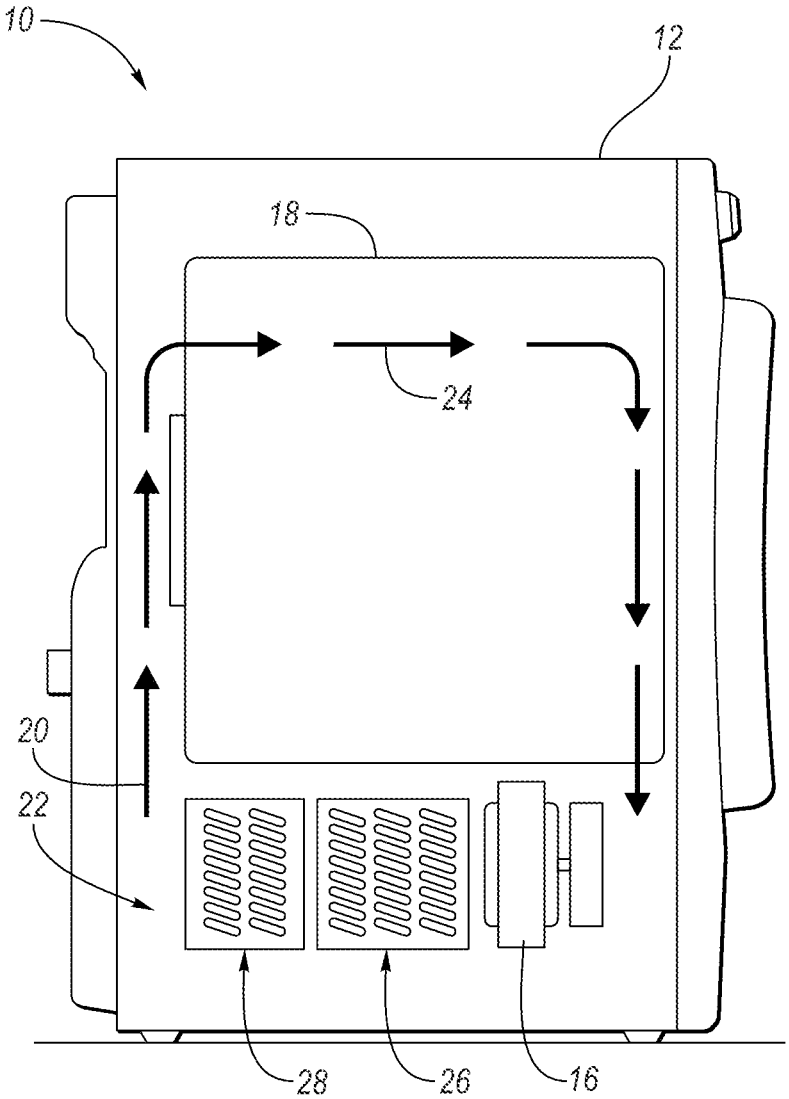
FIG. 1 is a schematic side view of a laundry appliance.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, a laundry appliance 10 is shown. The laundry appliance 10 in the illustrated embodiment is a clothes dryer but may be a washing machine in other embodiments. The dryer 10 includes a cabinet 12 and a rotating drum 18. The drum 18 is supported for rotational within the cabinet 12. The dryer 10 may be of the closed-loop type that has blower 16 circulating process air 20 through a recirculating airflow path 24 that includes the drum 18. The drum 18 and the blower 16 are activated in an operating state and deactivated in an idle state. The airflow path 24 operates to circulate process air 20 from the blower 16 within an air scroll panel 22 and moves the process air 20 into the drum 18. The process air 20 moves through the drum 18 and circulates within the drum 18. The process air 20 then moves through a return portion of the airflow path 24 back to the blower 16. Certain filters, heaters 28, heat exchangers 26, and other mechanical devices are incorporated within the airflow path 24 for treating and conditioning the process air 20 that is utilized during operation of the appliance 10.

Figure 2:
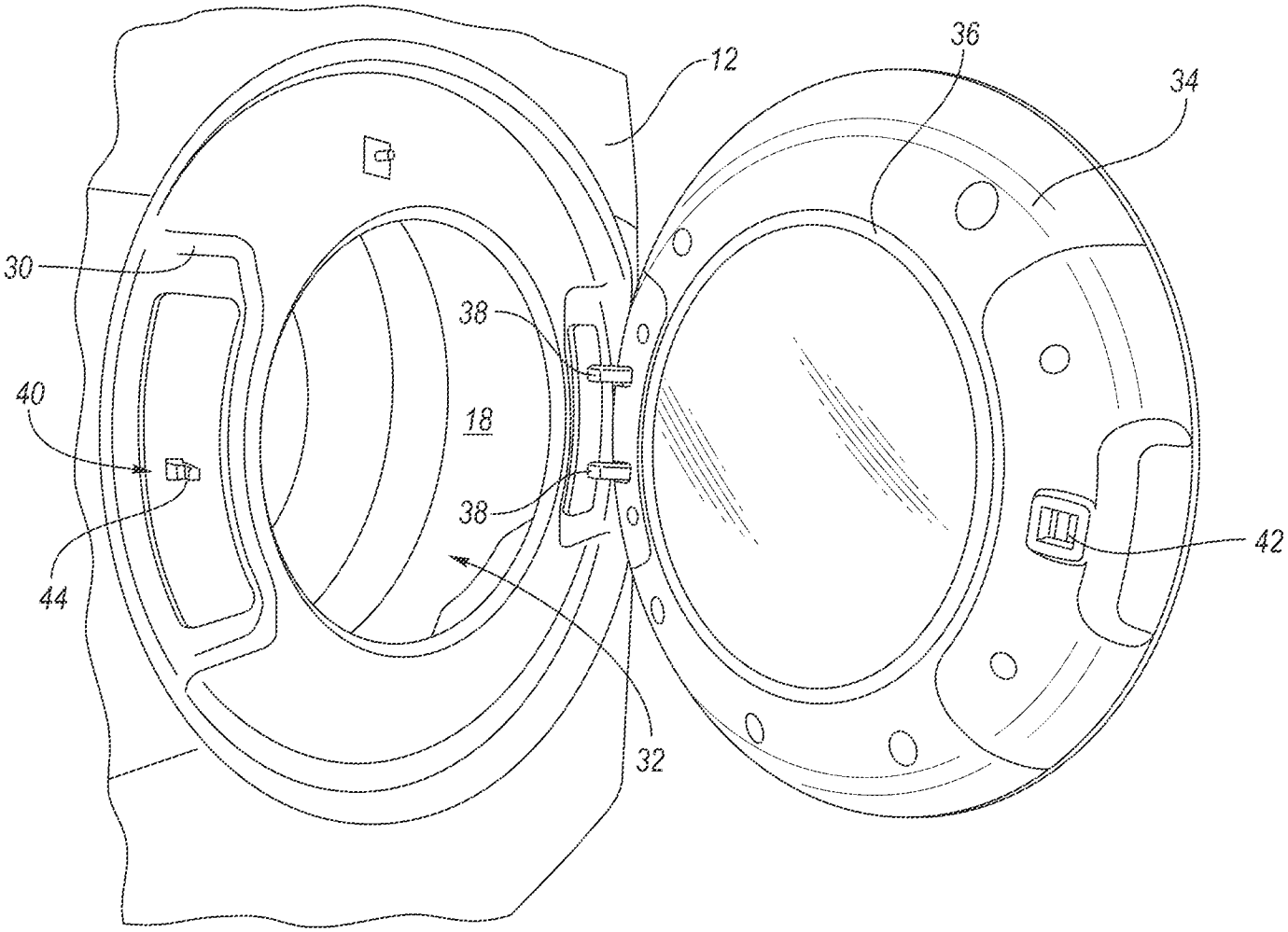
FIG. 2 is a perspective view of the laundry appliance.

Referring to FIG. 2, the cabinet 12 includes a front face 30 defining an opening 32 that provides access into the drum 18. The opening 32 allows a user to insert wet clothes into the drum 18 and to subsequently remove dry clothes from the drum 18 once drying is finished. The opening 32 is sealed by a door 34 pivotally attached to the cabinet 12 and movable between a closed position (FIG. 1) position sealing the opening 32 and an open position (FIG. 2) spaced from the opening 32. The door 34 may include a seal or gasket 36. The door 34 may be pivotably attached to the cabinet 12 via one or more hinges 38.

A latch assembly 40 secures the door 34 in the closed position when latched. The latch assembly 40 may include a catch 42 and a striker 44 that are configured to engage. The striker 44 may be mounted on the cabinet 12 and the catch 42 may be mounted on the door 34, or alternatively, the striker 44 may be mounted on the door 34 and the catch 42 may be mounted on the cabinet 12. The striker 44 and the catch 42 include features for latching or engaging the latch assembly 40 when they fully connect. The latch assembly 40 is further configured to prevent inadvertent latching of the latch assembly 40 to prevent the door 34 from inadvertently sealing or closing access to the drum 18. For example, the latch assembly 40 may require additional action by the user to fully close the door 34 or latch the striker 44 to the catch 42. For example, the user may be required to actuate an actuator when closing the door 34 in order to latch the latch assembly 40.

Different embodiments of the latch assembly 40 are described below. Each of these embodiments is configured to prevent inadvertent latching. Some of these embodiments accomplish this by misaligning the latch and the catch and others utilize a blocking element to sever the connection path between the latch and the catch or otherwise prevent contact between the striker and the catch.

Figure 3:
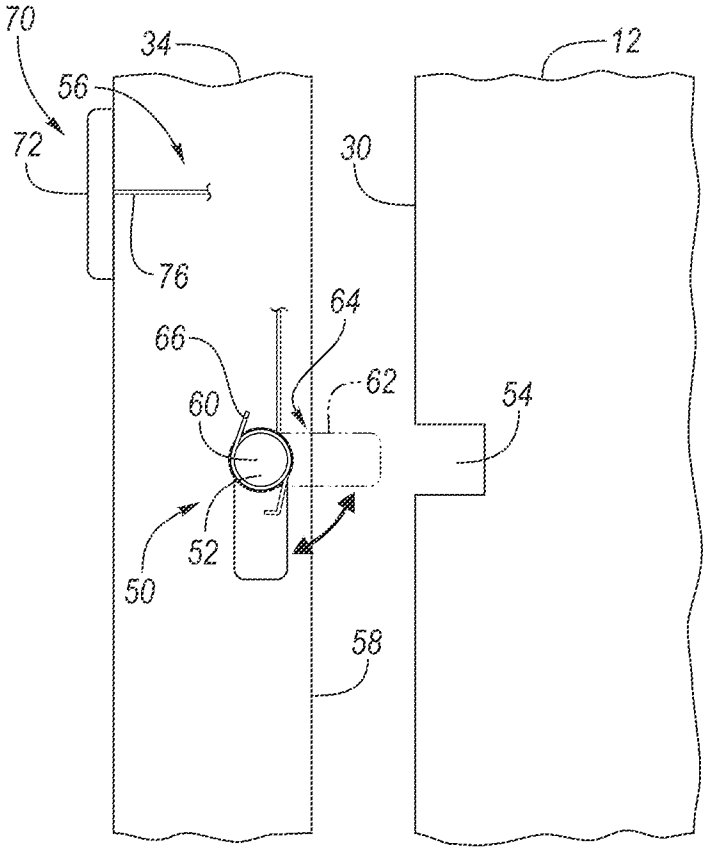
FIG. 3 is a diagrammatical view of a latch assembly for a laundry appliance according to an embodiment.

Referring to FIG. 3, a latch assembly 50 includes a rotating striker 52 and a stationary catch 54. In the illustrated embodiment, the striker 52 arranged on the door 34 and the catch 54 is on the cabinet 12; however, the striker 52 and the catch 54 may be switched in other examples. The striker 52 may be supported within an interior 56 of the door just under a panel 58 that faces the front face 30 of the cabinet 12. The striker 52 is supported for rotation about an axis that extends in the width (lateral) direction of the door 34.

The striker 52 may include a central body 60 and a projecting portion 62 configured to engage with the catch 54. The striker 52 includes a retracted position (shown in solid line) and an extended or deployed position (shown in phantom line). The striker 52 rotates about the axis to move between the retracted position and the extended position. When the striker 52 is in the retracted position, the striker 52 is disposed at least partially within the interior and cannot engage with the catch 54. (The striker may or may not be completely disposed within the interior 56.) Therefore, the door 34 cannot be latched to the cabinet 12. When the striker 52 is in the extended position, the projecting portion 62 extends past the panel 58 and is connectable with the catch 54. The panel 58 may define a slot or opening 64 allowing the projecting portion 62 to extend therethrough.

The striker 52 may be biased to the retracted position by a resilient member 66. The resilient member 66 may be a spring, such as a torsion spring, clock spring, a coil spring, or the like. In the illustrated embodiment, a torsion spring is shown. The torsion spring 66 is configured to urge the striker 52 to rotate towards the retracted position.

An external force may be required to rotate the striker 52 from the retracted position to the extended position. The latch assembly 50 may include an actuator 70 configured to generate the required external force. The actuator 70 may include a handle, button, or other element 72 that is operable by a user to actuate the latch 50 so that the door 34 can be fully closed and latched. In the illustrated embodiment, a handle 72 is shown. The handle 72 is operably coupled to the striker 52 so that actuation of the handle 72 rotates the projecting portion 62 to the extended position. For example, a tension member 76, e.g., a cable, may connect between the handle 72 and the striker 52. When a user pulls the handle, a tension force is applied to the cable causing the striker 52 to rotate against the spring 66. Once this tension force exceeds the force of the spring 66, the striker 52 rotates to the extended position. The user will may maintain this tension force until the door 34 is fully seated with the striker 52 received within the catch 54. Once the latch 50 is fully engaged, the user can release the handle 72 and the door 34 will remain in the closed position. The door 34 may be opened by simply pulling the door open and may not require actuation of the handle 72. In some embodiments, the actuator 70 may include a mechanism for holding the striker 52 in the extended position so that the user is not required to hold the handle during the door closure process. Instead, the user may briefly actuate the handle 72 and the holder mechanism will maintain the striker 52 in the extended position so that the user is not required to hold the handle 72 while the door is closed.

While the example of FIG. 3 is shown with the striker being mounted on the door and the catch being mounted on the cabinet, in other embodiments, the striker may be on the cabinet and the catch may be provided on the door. Here, the catch would be the rotating component and the striker would be stationary. Alternatively, the rotating catch or striker may on the cabinet and the stationary component on the door.

Figure 4:
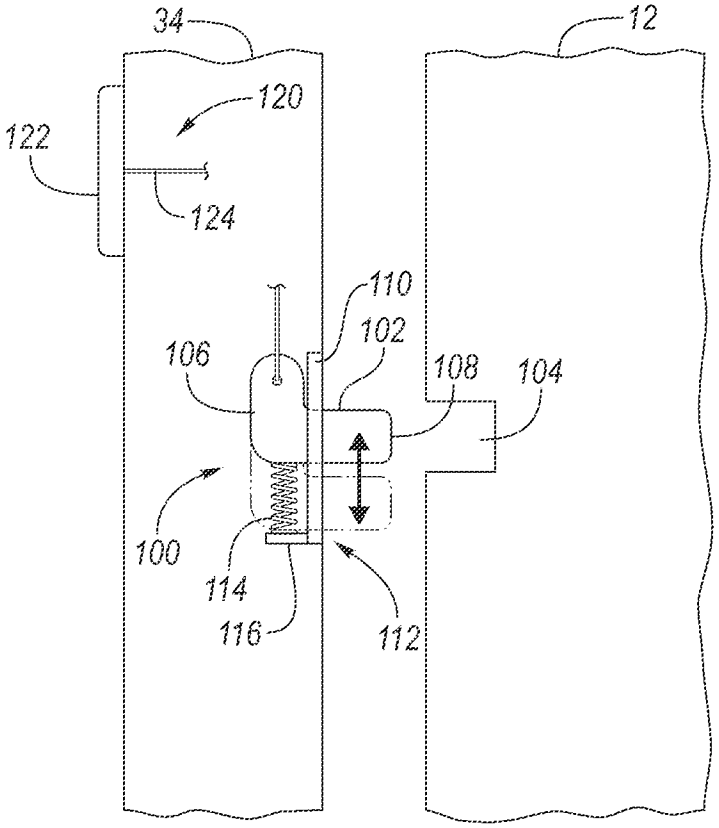
FIG. 4 is a diagrammatical view of a latch assembly for a laundry appliance according to another embodiment.

Referring to FIG. 4, a latch assembly 100 includes a sliding striker 102 and a stationary catch 104. In the illustrated embodiment, the striker 102 is mounted on the door 34 and the catch 104 is mounted on the cabinet 12, but the reverse is also contemplated. The striker 102 includes a portion 106 that is disposed within the interior of the door 34 and another portion 108 that extends outwardly from the door 34 to engage with the catch 104. The striker 102 may be configured to move vertically within the door 34, which places the striker 102 into, and out of, alignment with the catch 104. In this example, striker 102 is misaligned with the catch 104 when in the lower position (shown in phantom line) and is aligned with the catch 104 when in the upper position (shown in solid line). Thus, the door 34 can only be closed (and the latch 100 latched) when the striker 102 is in the upper position. The striker 102 is biased towards the lower position to prevent inadvertent latching of the door 34. That is, in order to latch the door 34, a user must move the striker 102 to the upper position. In other embodiments, the striker and catch may line in the lower position, in which case the striker may be biased to the upper position. In other embodiments, the moving component, e.g., the striker, may move left-and-right, diagonally, or in the other direction that allows for misalignment and realignment of the latch.

The striker 102 may be slidably supported by one or more guide members 110. In one example embodiment, the guide member 110 is a track that is attached the door 34. The track may be oriented vertically or any other suitable direction. The striker 102 is slidably supported along the track 110 allowing the striker 102 to move up and down between the upper and lower positions. The door 34 may define a slot or opening 112 that is vertically oriented and located adjacent to the guide member 110. The opening 112 provides clearance for the striker 102 to move up and down.

The striker 102 may be biased to the lower position by a resilient member 114. The resilient member may be attached between the portion 106 and an anchor 116 of the door interior. In one example embodiment, the resilient member 114 is a spring, such as a coil spring.

An external force is required to move the striker 102 from the lower position to the upper position. The latch assembly 100 may include an actuator 120 configured to generate the required external force. The actuator 120 may include a handle, button, or other element 122 that is operably by a user to actuate the latch so that the door 34 can be fully closed and latched. In the illustrated embodiment, a handle 122 is shown. The handle 122 is operably coupled to the striker 102 so that actuation of the handle 122 slides the striker 102 to the upper position. For example, a tension member 124, e.g., a cable, may connect between the handle 122 and the striker 102. When the handle 122 is pulled, a tension force is applied to the cable 124 urging the striker 102 to upwardly move against the spring 114. Once this tension force exceeds the force of the spring 114, the striker 102 will slide to the upper position and into alignment with the catch 104. The user will maintain this tension until the door is fully seated with the striker 102 received within the catch 104. Once the latch 100 is fully engaged, the user can release the handle 122 and the door 34 will remain in the closed position. The door 34 may be opened by simply pulling the door open and may not require actuation of the handle 122. In some embodiments, the actuator 120 may include a mechanism for holding the striker 102 in the upper position so that the user does not have to hold the handle during the door-closing process. Instead, the user may briefly actuate the handle 122 and the holder mechanism will maintain the striker 102 in the upper position so that the user is not required to hold the handle 122 while the door is closed.

While the example of FIG. 4 is shown with the striker being mounted on the door and the catch being mounted on the cabinet, in other embodiments, the striker may be on the cabinet and the catch may be provided on the door. Here, the catch would be the moving element and the striker would be stationary. Alternatively, the moving catch or striker may on the cabinet and the stationary component on the door.

The above-described embodiments of FIGS. 3 and 4 utilize movement of the striker or catch to prevent contact and inhibit latching. A different methodology may also be used, wherein a blocking member is used to prevent the striker and catch from connecting. The blocking member may be movable into, and out of, the connection path between the striker and catch. When the blocking member severs the connection path, the striker and catch cannot latch due to the physical barrier therebetween; when the blocking member is out of the connection path, the striker and catch are free to connect when the door is closed. In another example, the blocking member prevents the door from fully closing so that the striker and catch do not connect when the blocking member is deployed.

Figure 5:
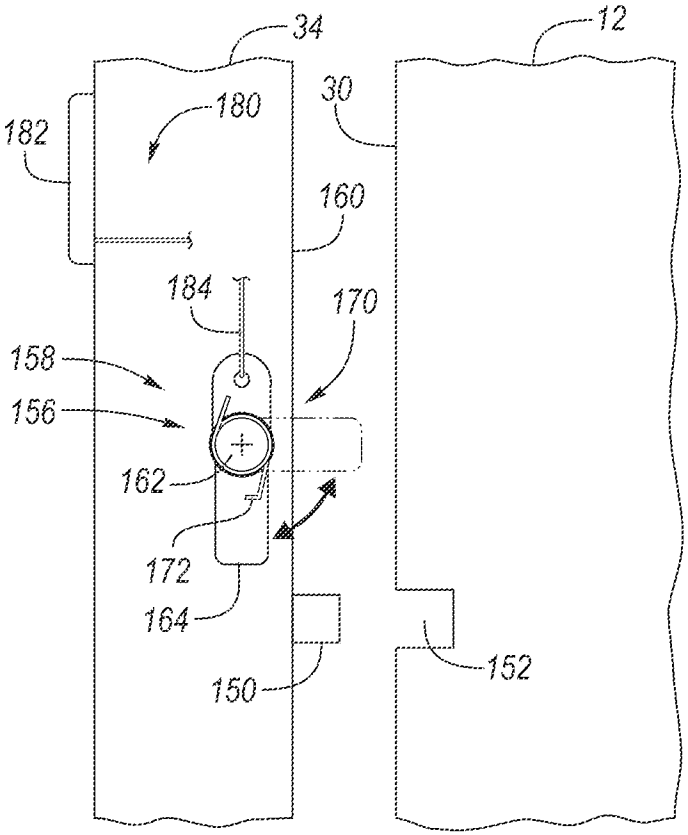
FIG. 5 is a diagrammatical view of a latch assembly and blocker for a laundry appliance according to yet another embodiment.

Referring to FIG. 5, the door 34 may support one of the catch and striker and the cabinet 12 may support the other of the catch and striker, which cooperate to latch when the striker is inserted into the catch. In the illustrated example, the striker 150 is mounted on the door 34 and the catch 152 is mounted on the cabinet 12. A blocking member 156 is configured to prevent latching of the door 34. The blocking member 156 may be mounted to the door 34 (as shown) or the cabinet 12. The blocking member 156 may include a retracted position (shown in solid line) where the door 34 can be latched and a blocking position (shown in phantom line) that inhibits the striker 150 from contacting the catch 152.

The blocking member 156 may be supported within an interior 158 of the door 34 under a panel 160 that faces the front face 30 of the cabinet 12. The blocking member 156 is supported for rotation about an axis that extends in the width (lateral) direction of the door 34. The blocking member 156 may include a central body 162 and a projecting portion 164, which is the portion that engages with the front face 30 of the cabinet 12 to prevent latching of the door 34. The projecting portion 164 is sized to project farther from the panel 160 than the striker 150 so that an air gap is maintained between the tip of the striker 150 and the catch 152 if the door 34 is closed with the blocking member 156 in the blocking position. The panel 160 may define a slot or opening 170 allowing the projecting portion 164 to extend therethrough.

The blocking member 156 rotates about the axis to move between the retracted position and the blocking position. When the blocking member 156 is in the retracted position, the projecting portion 164 is disposed within the interior 158 and cannot inhibit latching. When the blocking member 156 is in the blocking position, the projecting portion 164 extends past the striker 150 preventing contact with the catch 152. The blocking member 156 may be biased to the blocking position by a resilient member 172. The resilient member 172 may be a spring, such as a torsion spring, clock spring, a coil spring, or the like. In the illustrated embodiment, a torsion spring is shown. The torsion spring 172 is configured to urge the blocking member 156 to rotate towards the blocking position.

Similar to the example of FIG. 3, an actuator 180 may be used to rotate the blocking member 156 from the blocking position to the retracted position. The actuator 180 may include a handle, button, or other element 182 that is operable by a user to so that the door can be fully closed and latched. In the illustrated embodiment, a handle 182 is shown. The handle 182 is operably coupled to the blocking member 156 so that actuation of the handle rotates the projecting portion 164 to the retracted position. For example, a tension member 184, e.g., a cable, may connect between the handle 182 and the blocking member 156. When the handle is pulled, a tension force is applied to the cable 184 causing the blocking member 156 rotate against the spring 172. Once this tension force exceeds the force of the spring, the blocking member 156 will rotate to the retracted position. The user will maintain this tension force until the door is fully seated with the striker 150 received within the catch 152. Once the latch is fully engaged, the user can release the handle 182 and the door 34 will remain in the closed position. In some embodiments, the actuator 180 may include a mechanism for holding the blocking member 156 in the retracted position so that the user does not have to hold the handle during the door closure process. Instead, the user may briefly actuate the handle 182 and the holder mechanism will maintain the blocking member 156 in the retracted position so that the user is not required to hold the handle 122 while the door is closed.

Figure 6:
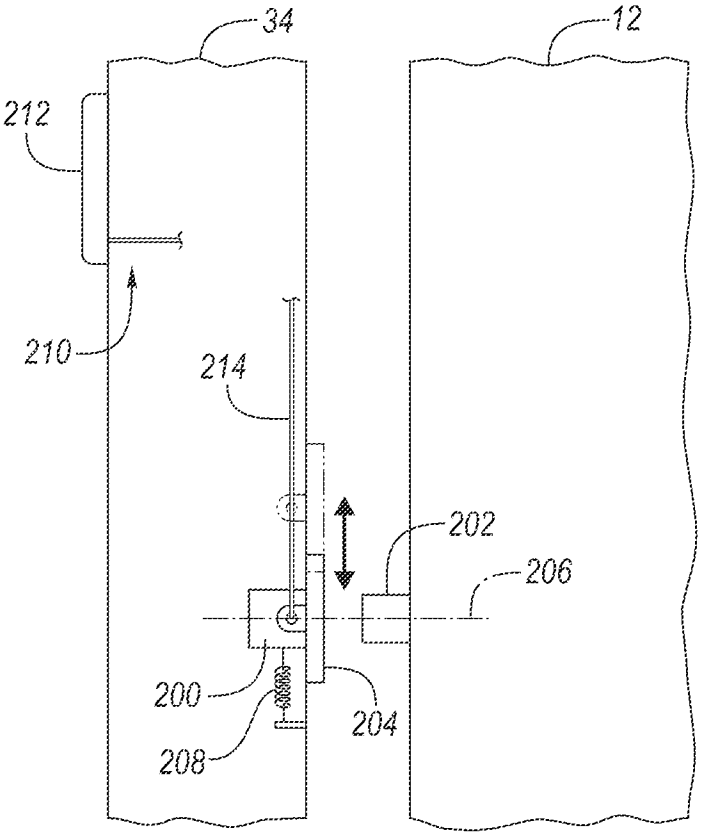
FIG. 6 is a diagrammatical view of a latch assembly and blocker for a laundry appliance according to a further embodiment.

Referring to FIG. 6, a blocking member 204 may be used to sever the connection path 206 between the catch 200 and the striker 202. The blocking member 204 may be movable into and out of the connection path 206. In the illustrated example, the blocking member 204 is vertically slidable up and down between a blocking position (shown in solid line) in which the blocking member 208 severs the connection path 206 and a retracted position (shown in phantom line) in which the blocking member 204 is outside of the connection path 206. Alternatively, the blocking member 208 may slide left and right, or any other direction, to move into and out of the connection path 206. The blocking member 204 may be external to the door 34 (as shown) or internal to the door.

The blocking member 204 is biased to the blocking position by a resilient member 208, such as spring. Example biasing mechanisms are described above and will not be repeated here for brevity. When the blocking member 204 is in the blocking position, it provides a physical barrier between the catch 200 and the striker 202. Any attempt to latch the door 34 when the blocking member is in the blocking position will result in the striker 202 contacting the blocking member 208 rather than the catch 200.

An actuator 210 may be used to move the blocking member 206 from the blocking position to the retracted position. In the illustrated embodiment, the actuator 210 is configured to slide the blocking member 204 upwardly and out of the way so that the striker 202 may be received within the catch 200 to latch the door. The actuator 210 may include a handle 212 (or other component as described above) connected to the blocking member 204 by a tension member 214 such as a cable. To close the door, a user may pull the handle to slide the blocking member 204 out of the way so that the door can be latched closed. A holding member may be included as described above.

The above-described latch assemblies and/or associated blocking members inhibit inadvertent latching of the door to the cabinet. This maintains air supply to the drum when in the idle condition in a closed-loop type dryer.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A laundry appliance comprising:
- a drum;
- a cabinet configured to support the drum for rotation therein, the cabinet including a front face defining an opening that provides access into the drum;
- a door pivotally attached to the cabinet and movable between a closed position and an open position; and
- a latch assembly configured to secure the door in the closed position, the latch assembly including:
  - a catch supported on one of an interior of the door and the front face,
  - a striker supported on the other of the within the interior of the door and the front face and engageable with the catch to latch the latch assembly, wherein one of the catch and striker is rotatable between a first position in which the catch and striker do not engage when the door is in the closed position and a second position in which the catch and striker are configured to engage when the door is in the closed position, wherein the one of the catch and striker is retracted into the interior when in the first position and projects outwardly from the door when in the second position,
  - a spring biasing the one of the catch and striker to the first position, and
  - an actuator operably coupled to the one of the catch and striker and configured to move the one of the catch and striker from the first position to the second position when actuated by a user.

2. The laundry appliance of claim 1, wherein the first position is a retracted position and the second position is an extended position.

3. The laundry appliance of claim 1, wherein the first position and the second position are vertically or laterally spaced from each other.

4. The laundry appliance of claim 1, wherein the one of the catch and the striker is the striker.

5. The laundry appliance of claim 1, wherein the one of the catch and the striker moves between the first and second position via rotation about an axis.

6. The laundry appliance of claim 1, wherein the actuator includes a handle.

7. The laundry appliance of claim 6, wherein the actuator includes a tension member connected between the handle and the actuator.

8. The laundry appliance of claim 7, wherein the tension member is a cable.

9. A laundry appliance comprising:
- a drum;
- a cabinet configured to support the drum for rotation therein, the cabinet including a front face defining an opening that provides access into the drum;
- a catch mounted on the front face;
- a door pivotally attached to the cabinet and movable between a closed position and an open position;
- a striker configured to engage with the catch, the striker being rotatably mounted within an interior of the door such that the striker rotates between a first position in which the catch does not engage with the striker when the door is in the closed position and a second position in which the catch and striker engage when the door is in the closed position to latch the door to the cabinet, wherein the striker is retracted into the interior when in the first position and projects outwardly from the door when in the second position;
- a resilient member urging the striker to rotate towards the first position; and
- an actuator configured to overcome the resilient member and rotate the striker towards the second position when actuated by a user.

10. The laundry appliance of claim 9, wherein the actuator includes a handle and a tension member connected between the handle and the actuator.

11. The laundry appliance of claim 9, wherein the first position and the second position are vertically spaced from each other.

12. The laundry appliance of claim 9, wherein the first position and the second position are laterally spaced from each other.

13. The laundry appliance of claim 9, wherein the striker moves between the first and second position via rotation about an axis.

14. A latch assembly for a laundry appliance comprising:
- a catch supported on a cabinet;
- a striker rotatably supported within an interior of a door and engageable with the catch to latch the latch assembly, wherein the striker is rotatable between a first position in which the catch and striker do not engage when the door is in a closed position and a second position in which the catch and striker are configured to engage when the door is in the closed position, wherein the striker is retracted into the interior when in the first position and projects outwardly from the door when in the second position;

a resilient member biasing the striker to the first position; and an actuator operably coupled to the striker and configured to move the striker from the first position to the second position.

15. The latch assembly of claim 14, wherein the actuator includes a handle.

16. The latch assembly of claim 15, wherein the actuator includes a tension member connected between the handle and the actuator.

17. The laundry appliance of claim 16, wherein the tension member is a cable.

18. The latch assembly of claim 14, wherein the first position and the second position are vertically spaced from each other.

19. The latch assembly of claim 14, wherein the first position and the second position are laterally spaced from each other.

20. The latch assembly of claim 14, wherein the striker moves between the first and second position via rotation about an axis.

* * * * *